United States Patent [19]

Walters et al.

[11] Patent Number: 4,592,466

[45] Date of Patent: Jun. 3, 1986

[54] CONTAINER CARRIER AND PACKAGE

[75] Inventors: Peter J. Walters, Roselle; William N. Weaver, Northbrook, both of Ill.

[73] Assignee: Illinois Tool Works Inc.

[21] Appl. No.: 715,557

[22] Filed: Mar. 25, 1985

[51] Int. Cl.[4] ..... B65D 85/66

[52] U.S. Cl. ..... 206/150

[58] Field of Search ..... 206/150

[56] References Cited

U.S. PATENT DOCUMENTS

| | | | |
|---|---|---|---|
| 2,740,657 | 4/1956 | Poupitch | 206/150 |
| 2,936,070 | 5/1960 | Poupitch | 206/150 |
| 3,374,028 | 3/1968 | Wanderer | 206/150 |
| 4,033,457 | 7/1977 | Weaver | 206/150 |

*Primary Examiner*—Joseph Man-Fu Moy

*Attorney, Agent, or Firm*—Thomas W. Buckman

[57] ABSTRACT

A container package comprises a sheet of plastic material having a plurality of apertures therein and a like plurality of containers respectively received in said apertures. Each container comprises a plastic bottle having a laminated plastic and foil cover heat sealed thereover. Each container has a rim with a maximum diameter and a subjacent portion tapering downwardly and inwardly from said maximum diameter. The cover has an edge on said subjacent portion. The apertures in the carrier are initially elongated longitudinally of the carrier and are provided with scalloped margins. The margins are of lesser diameter than the upper ends of the containers, whereby the margins are stretched and deflected upwardly along said subjacent portion with the margins lying above the respective cover edges.

1 Claim, 5 Drawing Figures

CONTAINER CARRIER AND PACKAGE

BACKGROUND OF THE INVENTION

Apertured sheet plastic carriers for containers such as cans or bottles are known in the art. The earliest of these is U.S. Pat. No. 2,874,835 wherein circular apertures were utilized in the carrying of circular cans. The margins of the apertures were stretched and deflected to engage beneath the can bead. Generally circular apertures, but having scalloped margins are shown in U.S. Pat. No. 3,946,535 for carrying bottles with the tabs between the scallops engaging beneath the rims or beads at the upper ends of the bottle necks. Non-circular apertures for use with cylindrical containers are shown in U.S. Pat. No. 4,219,117. A narrower band of blank material can be used when apertures are elongated longitudinally of the blank band of material, and are stretched into circular configuration by mounting about cylindrical containers. Hence, there is less scrap.

A common feature of such prior art plastic carriers and the well-know resulting "six-pack" of carrier and containers has been that the plastic material at the margin of each aperture has been stretched and turned upwardly beneath the rim or bead at the top of a container. Release of a container from the carrier has been effected by pulling sideways on a desired container to stretch the material about the corresponding aperture, and then tipping the container out of the stretched encircling plastic.

A new type of container is now available, comprising a wide mouth plastic bottle having a foil and plastic lamination placed over the open mouth of the bottle, crimped about the top rim thereof, and heat sealed thereto. Prior art plastic carriers as outlined heretofore are not satisfactory for carrying such containers, as the stretched margins of the material of the carrier about each aperture would engage beneath the foil covering and peel it from the bottle.

OBJECTS AND SUMMARY OF THE PRESENT INVENTION

It is an object of the present invention to provide a sheet plastic carrier for foil topped wide-mouthed containers and a resulting package of such containers and carrier.

It is a more specific object of the present invention to provide a carrier as just set forth in which the openings for receipt of the containers are scalloped.

A wide-mouth container or bottle is provided with a rolled upper rim receding slightly in diameter from a maximum and joining to an underlying container wall in an annular concavity. A laminated plastic and foil cover is rolled over such rim and crimped thereto, and heat sealed to the plastic container. In accordance with the present invention a plurality of such containers, six being exemplary, is assembled with a plastic carrier. The carrier is provided with corresponding openings having scalloped margins, initially elongated longitudinally of the carrier, and of lesser circumference than the concavities of the supported containers. Portions of the carrier initially outwardly of the apertures engage in the concavities with the scalloped margins spaced above the bottom edges of the foil-plastic laminate tops to avoid peeling of the tops or covers from the containers.

THE DRAWINGS

The present invention will best be understood with reference to the following specification when taken in connection with the accompanying drawings wherein.

DETAILED DESCRIPTION OF THE ILLUSTRATED EMBODIMENT

Figure 1:
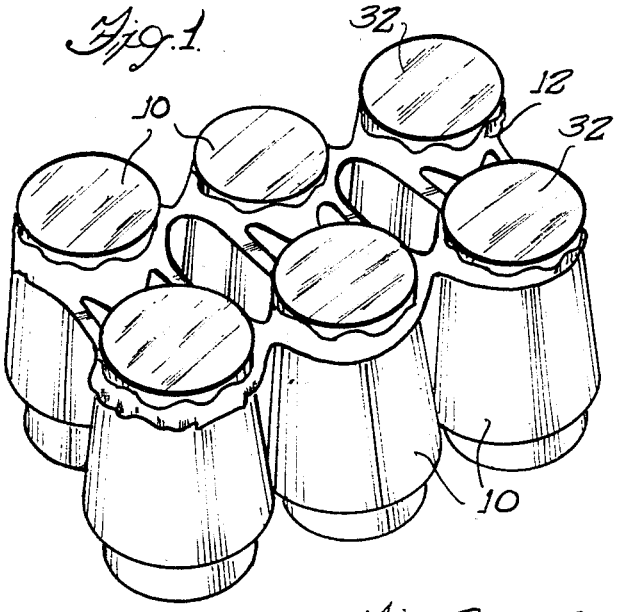
FIG. 1 is a perspective view of a package comprising the carrier of the present invention and a plurality of containers carried thereby.
Figure 2:
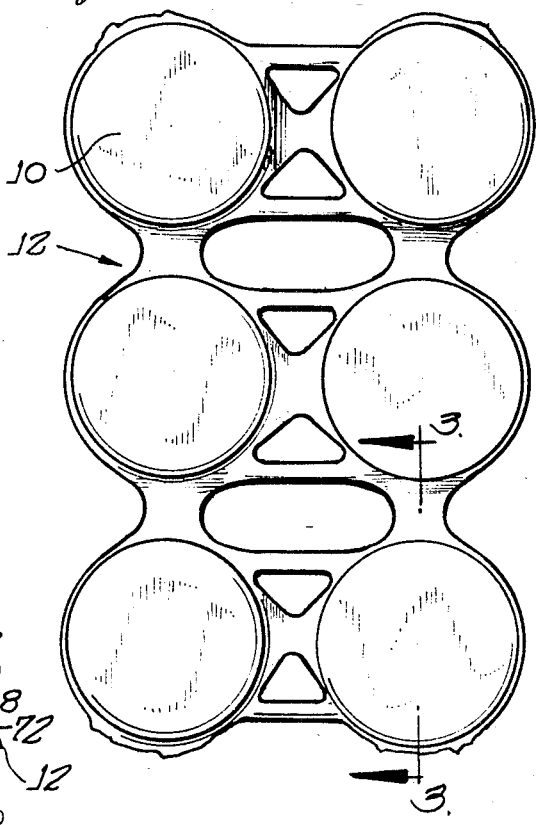
FIG. 2 is a top view of the package of FIG. 1 on an enlarged scale.
Figure 3:
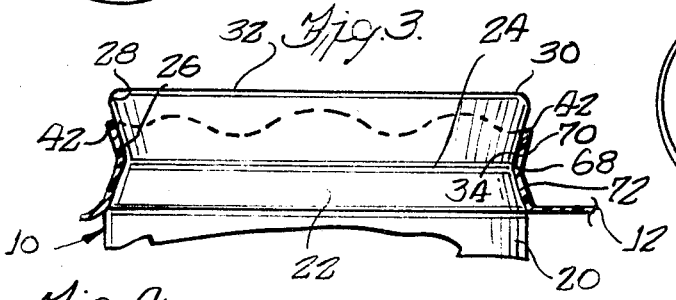
FIG. 3 is a fragmentary cross-sectional view taken substantially along the line 3—3 in FIG. 2 on a further enlarged scale.
Figure 4:
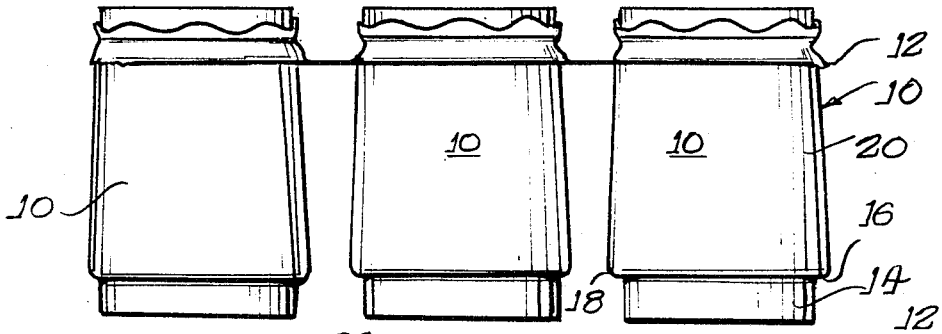
FIG. 4 is a side view of the package of FIGS. 1 and 2.

Turning now in greater particularity to the drawings, and first to FIGS. 1–4, there will be seen a plurality of containers 10 supported by a sheet plastic carrier 12. Each container 10 comprises a wide-mouth plastic bottle having a bottom portion 14 tapering upwardly and outwardly at a shallow angle to a substantially right angle shoulder or step 16 at which point the bottle reaches a maximum diameter 18. From this point the bottle tapers inwardly at a shallow angle forming a body 20. At the top of the body the bottle tapers more sharply inwardly at 22 to a ring or annular concavity 24 of minimum diameter. The bottle than extends upwardly and tapers outwardly as a rim 26, finally being rolled over at 28 to a flat, open mouth top 30. Each bottle 10 has a circular cross-section throughout.

Figure 5:
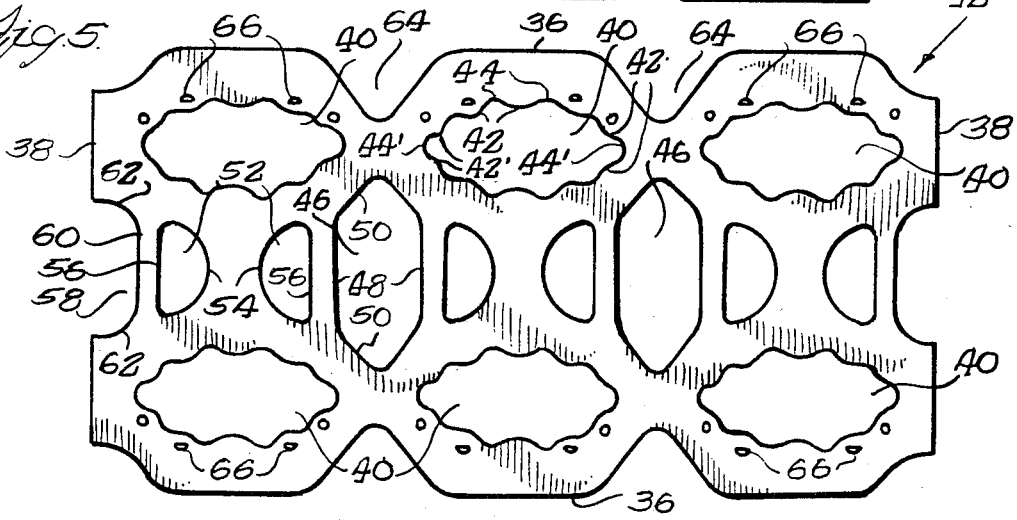
FIG. 5 is a plan view of the carrier before assembly with the containers.

A top, cover, or lid 32 of laminated foil and plastic surmounts each open top, and is crimped down along the tapered rim 26 to the ring 24 of minimum diameter, the cover being heat sealed to the bottle. The cooperation of the carrier 12 with the containers 10 in such manner as to avoid engaging beneath the lower margin 34 of the top cover 32, which could peel it from place will be discussed hereinafter following a description of the carrier 12 as best seen in FIG. 5.

The carrier 12, before assembly with the containers, is relatively elongated, and has straight, but interrupted, longitudinal sides or edges 36 resulting from formation of a succession of carriers from a blank band or strip of suitable resilient plastic material which is resilient, deformable and elastic, polyethylene being a preferred example. Preferably there is provided a long succession of interconnected carriers 12 after the fashion disclosed in U.S. Pat. No. 3,946,535, and assembly of the strip of carriers with the containers is similar to that disclosed in said patent. Only one carrier is shown in FIG. 12, having transverse ends 38 where one carrier is severed from another. The carrier 12 is provided with six container receiving apertures 40 arranged in pairs which are symmetric about the center line of the carrier. Each aperture 40 is elongated in the longitudinal direction of the carrier and is of generally oval or eliptical shape.

Specifically, the margin of each aperture 40 is of a scalloped nature, having a plurality of alternating tabs 42 and recesses or scallops 44. Each of the tabs 42 is formed as an arc of a circle, all of the tabs being of the same radius with the exception of the tabs 42' adjacent the longitudinally opposite ends of each aperture, which are formed of slightly shorter radius than the other tabs. By way of specific example, the tabs 42' have a radius of 0.1875 inch, while all of the other tabs have a radius of 0.250 inch. The recesses or scallops 44 are also circular arcs, and all are of the same radius except for the recesses 44' at the longitudinally opposite ends of each aperture 40, these recesses or scallops being of slightly larger radius than the others. Specifically, and on the same scale as noted heretofore, by way of example, the recesses or scallops 44' have a radius of 0.1250 inch, while all of the the other scallops or recesses have a radius of 0.0937 inch. The differences in radius of the end recesses 44' as compared with the other recesses, and the similar differences in radius of the tab 42' as compared with the other tabs facilitates stretching of the apertures into circular shape with minimal stress in the material from which the carrier is formed, and producing uniform gripping of each container in a respective aperture.

Each carrier 12 further is provided with a pair of finger gripping apertures 46 which are elongated transversely of the carrier and which are respectively disposed midway between successive container receiving apertures 40. The apertures 46 each comprise parallel front and rear edges 48 perpendicular to the center line of the carrier and elongated transversely thereof. The edges 48 join to lateral end portions 50 of generally triangular shape, each of the straight edges of the apertures 46 being joined by circular arcs to minimize stress.

In addition, between each pair of laterially aligned container receiving apertures 40 there is disposed a pair of generally D-shaped apertures 52, comprising arcuate edges 54 generally confronting one another, and remote straight edges 56, the arcuate and straight edges being interconnected by circular arcs to avoid stress concentrations.

End opening apertures or recesses 58 comprise transverse straight edges 60 and arcuate lateral edges 62 which more or less align with the end portions of the arcuate edges 54 of the D-shaped apertures 52.

Generally triangular recesses 64 are provided in the longitudinal edges of the carrier intermediate successive container receiving apertures 40, the edges thereof being joined to one another and to the longitudinal edges by circular arcs, again to avoid stress concentrations. Finally, rather small semi-circular pin slots 66 are provided outboard of each pair of container receiving apertures 40, and respectively on the centers of the arcs forming the adjacent tabs 42. These receive pins of the assembling machine as disclosed in U.S. Pat. No. 3,946,535 for assembling the carrier with the containers.

When the carrier is assembled with the containers in the manner disclosed in U.S. Pat. No. 3,946,535, pins in the assembling machine are received in the semi-circular slots 66, and pull the material of the carrier outwardly away from the center line thereof, partially to stretch the container receiving apertures 40 toward circular shape. The semi-circular nature of the apertures 66 provides a curved surface for the pins to bear against, thus minimizing stress in the material of the carrier. The apertures 40 further are moved into a circular configuration as they are pressed over the tops of the containers. The provision of the D-shaped apertures 52 allows the material between confronting pairs thereof to buckle as the inboard portions of the apertures 40 are forced toward circular position. The outboard portions adjacent the longitudinal edges 36 are unrestrained, and readily move toward circular position.

The diameter of the upper portion of each container is greater than the periphery of each container receiving aperture 40, particularly as considered along the apices of the scallops 44 and 44'. As a result, the tabs 42 (see FIG. 3) are folded back along the surface of the foil-plastic cover 30 so that a portion of the plastic carrier as indicated at 68 overlies the minimum diameter portion 24 of the container, with a previously inward portion adjacent the margin of the container receiving aperture being flexed upwardly and outwardly and embracing the outwardly and upwardly tapering rim of the container. A portion 72 of the carrier outwardly from the aperture 40 engages the container below the minimum diameter portion 24. It is important to note that the upper (formerly inner) edge 42, 44 lies entirely above the bottom margin of the foil 34, and therefore does not tend to peel the foil off of the bottle. This is an important feature of the present invention and distinguishes from the prior art in which an edge or margin or an aperture and a carrier fits beneath a bead or other outward projection on a container. The shape of each container receiving aperture prior to assembly also is important in that the aperture is initially oval rather than circular, and has a scalloped margin with certain of the scallops and intervening tabs being of different size than others.

When it is desired to remove a bottle or container from the package, the particular bottle is pulled laterally to stretch the encircling band of plastic material of the carrier, whereby the bottle then may be tipped out of the aperture in which it has been held.

The specific example of the invention as herein shown and described is for illustrative purposes. Various changes in structure will no doubt occur to those skilled in the art and will be understood as forming a part of the present invention insofar as they fall within the spirit and scope of the appended claims.

The invention is claimed as follows:

1. A carrier for carrying a plurality of containers provided with a cover incorporating a skirt which extends downwardly from the upper extremity of the container, the carrier comprising a substantially unsupported sheet of plastic material having a longitudinal dimension, said sheet of plastic material being resilient, deformable and elastic and having a plurality of apertures therein, each of said apertures being elongated longitudinally of said carrier and having a scalloped margin comprising alternating tabs and scallops arranged to locate scallops at the longitudinal extremities of the apertures, the tabs adjacent the longitudinal extremities being shorter than the tabs of the other regions of the apertures, the circumferential dimension of each of said apertures through the apices of the scallops being less than said circumference whereby the margin of each of said apertures must be stretched and flexed to receive a container, wherein the location and dimension of the tabs and scallops permit signficant stretching of the carrier respective to lateral stretching forces yet permitting at least portions of the tabs to overlie the lowermost edge of the skirt of the cover.

* * * * *